US005942747A

United States Patent [19]

Saldana

[11] Patent Number: 5,942,747

[45] Date of Patent: Aug. 24, 1999

[54] NIGHT VISION DEVICE WITH VOLTAGE TO PHOTOCATHODE HAVING A RECTIFIED HALF-SINE WAVE COMPONENT

[75] Inventor: Michael R. Saldana, New Braunfels, Tex.

[73] Assignee: Litton Systems, Inc., Woodland Hills, Calif.

[21] Appl. No.: 08/901,424

[22] Filed: Jul. 28, 1997

[51] Int. Cl.[6] ..... H01J 40/14

[52] U.S. Cl. ..... 250/214 VT; 313/103 R

[58] Field of Search ..... 250/214 VT, 214.1, 250/214 AG, 214 RC, 214 R; 313/103 R, 537, 105 CM, 528, 539, 542–544

[56] References Cited

U.S. PATENT DOCUMENTS

| | | | |
|---|---|---|---|
| 4,037,132 | 7/1977 | Hoover | 250/214 VT |
| 4,442,349 | 4/1984 | Blom et al. . | |
| 4,935,616 | 6/1990 | Scott . | |
| 5,146,077 | 9/1992 | Caserta et al. . | |

*Primary Examiner*—Que T. Le
*Attorney, Agent, or Firm*—Terry L. Miller

[57] ABSTRACT

A night vision device which applies a time-varying voltage to the photocathode of the device during periods of high average light intensity from a scene being viewed. The purpose of applying this time-varying voltage during periods of high average light intensity is to reduce the average current through the photocathode, thus increasing reliability for the night vision device while preserving image resolution.

14 Claims, 3 Drawing Sheets

FIG. 1.
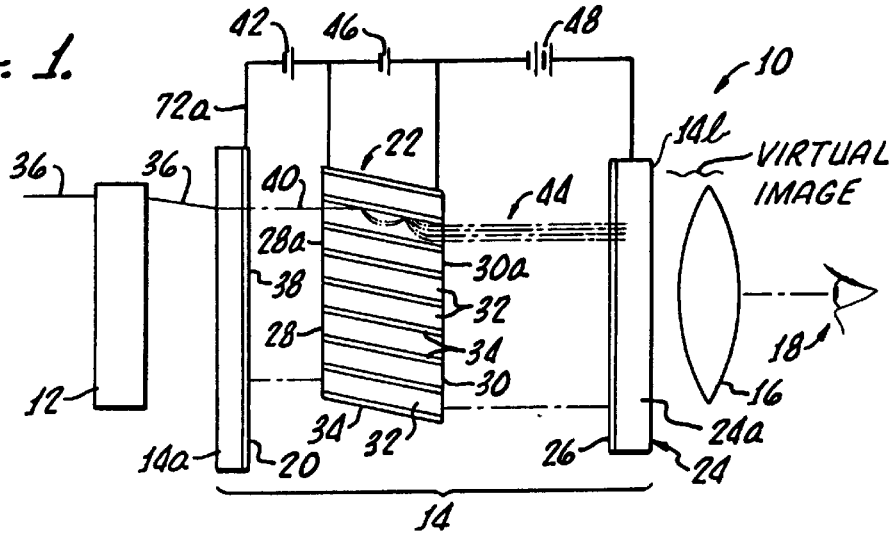
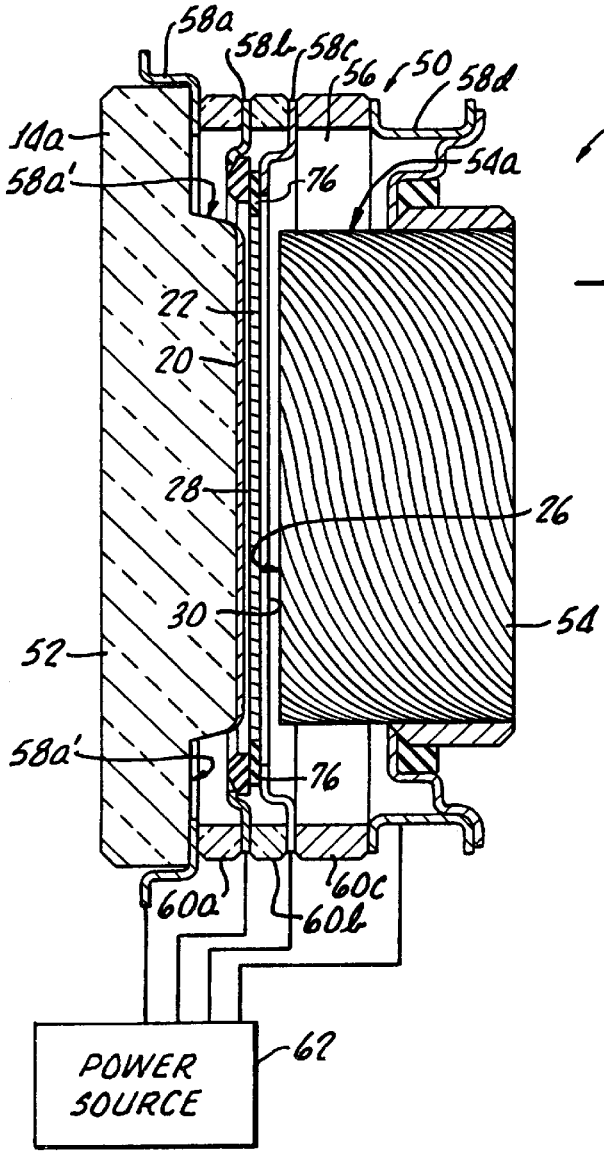
FIG. 2.

NIGHT VISION DEVICE WITH VOLTAGE TO PHOTOCATHODE HAVING A RECTIFIED HALF-SINE WAVE COMPONENT

CROSS-REFERENCES TO RELATED APPLICATIONS

This application is related to the following other applications:

U.S. patent application Ser. No. 08/1901,415;

U.S. patent application Ser. No. 08/901,416;

U.S. patent application Ser. No. 08/901,418;

U.S. patent application Ser. No. 08/901,419;

U.S. patent application Ser. No. 08/901,421;

U.S. patent application Ser. No. 08/901,422; and

U.S. patent application Ser. No. 08/901,423, all filed Jul. 28 1997.

The entire content of each of these related applications is incorporated herein by reference.

FIELD OF THE INVENTION

The present invention is in the field of night vision devices of the light amplification type. More particularly, the present invention relates to night vision device having an image intensifier tube ($I^2T$) and a power supply for the $I^2T$ which operates the tube in a unique way to improve the resolution and reliability of the device under bright scene conditions. A method of operating the $I^2T$ and a method of operating the power supply are disclosed also.

BACKGROUND OF THE INVENTION

Even on a night which is too dark for diurnal vision, invisible infrared light is richly provided by the stars. Human vision cannot utilize this infrared night time light from the stars because the so-called near-infrared portion of the spectrum is invisible for humans. A night vision device of the light amplification type can provide a visible image replicating the night time scene. Such night vision devices generally include an objective lens which focuses invisible infrared light from the night time scene onto the transparent light-receiving face of an $I^2T$. At its opposite image-face, the image intensifier tube provides an image in visible yellow-green phosphorescent light, which is then presented to a user of the device via an eye piece lens.

A contemporary night vision device will generally use an $I^2T$ with a photocathode behind the light-receiving face of the tube. The photocathode is responsive to photons of infrared light to liberate photoelectrons. These photoelectrons are moved by a prevailing electrostatic field to a microchannel plate having a great multitude of dynodes, or microchannels, with an interior surface substantially defined by a material having a high coefficient of secondary electron emissivity. The photoelectrons entering the microchannels cause a cascade of secondary emission electrons to move along the microchannels so that a spatial output pattern of electrons which replicates an input pattern, and at a considerably higher electron density than the input pattern results. This pattern of electrons is moved from the microchannel plate to a phosphorescent screen by another electrostatic field to produce a visible image.

A power supply for the $I^2$provides the electrostatic field potentials referred to above, and also provides a field and current flow to the microchannel plate(s). Conventional night vision devices (i.e., since the 1970's and to the present day) provide automatic brightness control (ABC), and bright source protection (BSP). BCP maintains the brightness of the image provided to the user substantially constant despite changes in the brightness (in infrared and the near-infrared portion of the spectrum) of the scene being viewed. BSP prevents the $I^2T$ from being damaged by an excessively high current level in the event that a bright source, such as a flare or fire, comes into the field of view.

BSP and sometimes even ABC can be implemented by reducing the voltage on the photocathode as the intensity of the scene being viewed increases. Changes in this intensity are typically reflected by changes in the overall current flowing through the photocathode.

As a practical matter, however, the voltage on the photocathode cannot be reduced below a threshold level called the charge voltage for the tube. The charge voltage is the minimum level of voltage which is necessary for the photocathode to liberate electrons of sufficient energy to penetrate the ion barrier at the front face of the microchannel plate. If the applied voltage is less than the charge voltage, the photocathode will not function at all.

The circuitry which reduces the voltage applied to the photocathode in response to high intensity scene levels, therefore, must insure that the applied voltage does not drop below the charge voltage. In the prior art, this has typically been done by a clamping circuit which clamps the voltage applied to the photocathode to no less than a pre-determined minimum amount.

This prior art clamping circuit, however, provides far less that an ideal solution. The problem lies in the fact that the charge voltage typically varies substantially for photocathodes of the same type. To insure that no photocathode is disabled by the voltage-reducing circuitry, the clamping voltage must therefore be set at a level which is higher than the highest value of anticipated charge voltage in the entire set of photocathodes.

Setting the clamping voltage at this high level results in many photocathodes receiving a minimum voltage level far above the level which would be ideal for these photocathodes. This forces these photocathodes to operate at an unduly high current level under very bright conditions, degrading the resolution and reliability of the photocathodes. The problem is particularly acute for today's performance tubes which are much more photo-sensitive.

SUMMARY OF THE INVENTION

One object of the present invention is to obviate these as well as other problems in prior art night vision devices and the power supplies associates with them.

Another object of the present invention is to improve the resolution of night vision devices under very bright scene conditions.

Another object of the present invention is to improve the reliability of night vision devices under very bright scene conditions.

Another object of the present invention is to improve BSP and ABC under very bright scene conditions.

A still further object of the present invention is to reduce the average current flowing in the photocathode of a night vision device during bright scene conditions, without applying a voltage to the photocathode below the charge voltage for the photocathode.

Another object of the present invention is to improve the resolution, reliability, and BSP and ABC of a prior art night vision device by making merely a minor change to it.

These as well as still further objects, benefits and advantages of the present invention are achieved by applying a time-varying voltage waveform to the photocathode at least during periods of high scene intensity, as opposed to the DC waveform applied by the clamping circuitry of the prior art. The peaks of this time-varying waveform insure that the voltage on the photocathodes exceed their charge voltage. The lower values of voltage during the non-peak times cause an effective overall current through the photocathodes which is substantially less than the current which would have flowed had the voltage to the photocathodes remained at the peak level throughout. The effect is a reduction in the current which degrades the resolution and reliability of the photocathode, without a reduction in the peak levels of the voltage, thus insuring that the tube continues to operate.

In one embodiment of the present invention, the invention is implemented by merely making a slight change to a prior art circuit. The slight change of the circuitry of the prior art device causes its clamping voltage to be an alternating current, rather than the direct current which the prior art circuit supplied prior to the modification. Once this change is made, the time-varying voltage which the modified prior art circuit generates has substantially the appearance of a half-wave rectified sine wave. This time-varying voltage, moreover, is only applied during periods when a substantial reduction in the voltage to the photocathode is needed to compensate for scene light which is very high in average intensity.

Other objects, features, and advantages of the present invention will become apparent to those skilled in the art from a consideration of the following detailed description of preferred exemplary embodiments thereof, taken in conjunction with the associated figures which will first be described briefly.

BRIEF DESCRIPTION OF THE DRAWINGS

FIG. 1 is a schematic representation of a night vision device embodying the present invention;

FIG. 2 shows an $I^2T$ in longitudinal cross section, with an associated power supply embodying the present invention;

DETAILED DESCRIPTION OF EXEMPLARY EMBODIMENTS OF THE INVENTION

Figure 3:
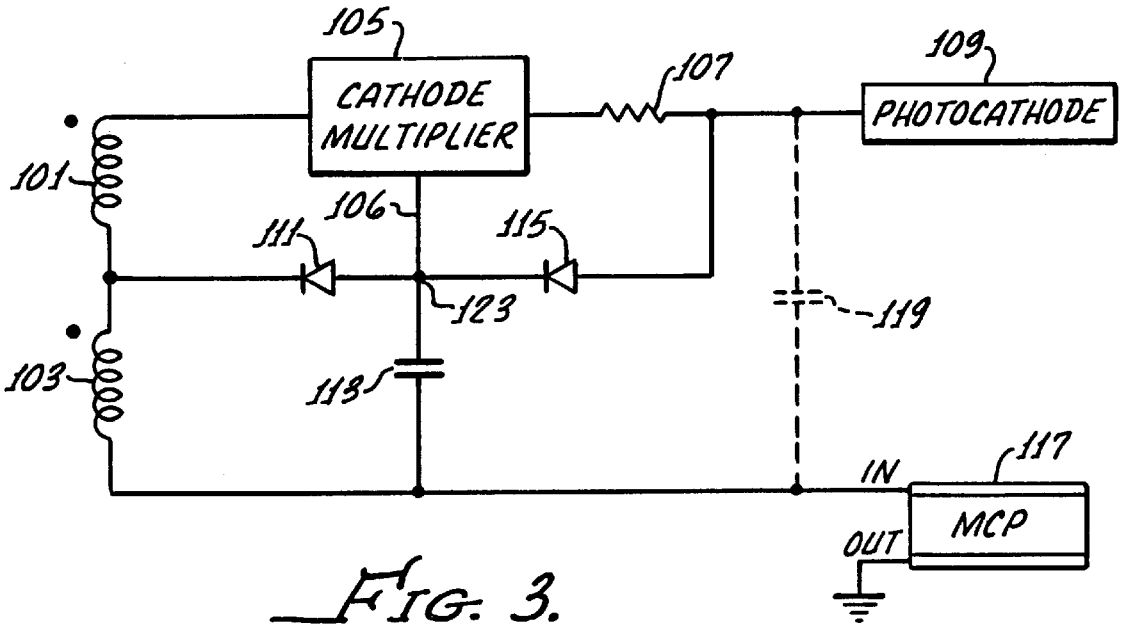
FIG. 3. (PRIOR ART)
FIG. 3 is a schematic illustration of a section of a prior art power supply used to deliver high voltage to the photocathode of a night vision device.

While the present invention may be embodied in many different forms, disclosed herein are specific exemplary embodiments that illustrate and explain the principles of the invention. It should be emphasized that the present invention is not limited to the specific embodiments illustrated.

Referring first to FIG. 1, there is shown schematically the basic elements of one version of a night vision device 10 of the light amplification type. Night vision device 10 generally comprises a forward objective optical lens assembly 12 (illustrated schematically as a functional block element—which may include one or more lens elements). This objective lens 12 focuses incoming light from a distant night-time scene on the front light-receiving end 14*a* of an $I^2T$ 14 (as will be seen, this surface is defined by a transparent window portion of the tube—to be further described below). As was generally explained above, the $I^2T$ provides an image at light output end 14*b* in phosphorescent yellow-green visible light which replicates the night-time scene. This night time scene would generally be not visible (or would be only poorly visible) to a human's diurnal vision. This visible image is presented by an eye piece lens illustrated schematically as a single lens 16 producing a virtual image of the rear light-output end of the tube 14 at the user's eye 18.

More particularly, $I^2T$ 14 includes a photocathode 20 which is responsive to photons of infrared light to liberate photoelectrons, a microchannel plate 22 which receives the photoelectrons in a pattern replicating the night-time scene, and which provides an amplified pattern of electrons also replicating this scene, and a display electrode assembly 24. In the present embodiment the display electrode assembly 24 may be considered as having an aluminized phosphor coating or phosphor screen 26. When this phosphor coating is impacted by the electron shower from microchannel plate 22, it produces a visible image replicating the pattern of the electron shower. Because the electron shower pattern still replicates the scene viewed via lens 12, a user of the device can effectively seen in the dark, by only star light or other low-level illumination. A transparent window portion 24*a* of the assembly 24 conveys the image from screen 26 outwardly of the tube 14 so that it can be presented to the user 18.

Alternatively, as those ordinarily skilled in the pertinent arts will know, the output electrode assembly may include a charge coupled device (CCD). In this case, the reference numeral 26 would indicate such a CCD, with the output of the image intensifier tube being in the form of an image signal from this CCD. The user of such a device would view the image information on a display, such as a liquid crystal display, or cathode ray tube.

Still more particularly, microchannel plate 22 is located just behind photocathode 20, with the microchannel plate 22 having an electron-receiving face 28 and an opposite electron-discharge face 30. This microchannel plate 22 further contains a plurality of angulated microchannels 32 which open on the electron-receiving face 28 and on the opposite electron-discharge face 30. Microchannels 32 are separated by passage walls 34. The display electrode assembly 24, generally has a conductive coated phosphor screen 26, is located behind microchannel plate 22 with phosphor screen 26 in electron line-of-sight communication with the electron-discharge face 30. Display electrode assembly 24 is typically formed of an aluminized phosphor screen 26 deposited on the vacuum-exposed surface of the optically transparent material of window portion 24*a*. The focusing eye piece lens 16 is located behind the display electrode assembly 24 and allows an observer 18 to view a correctly oriented image corresponding to the initially received low-level image.

As will be appreciated by those skilled in the art and also viewing now FIG. 2, the individual components of $I^2T$ 14 are all mounted and supported in a tube or chamber (to be further explained below) having forward and rear transparent plates cooperating to define a chamber which has been evacuated to a low pressure. This evacuation allows electrons liberated into the free space within the tube to be transferred between the various components by prevailing electrostatic fields without atmospheric interference that could possibly decrease the signal-to-noise ratio.

As indicated above, photocathode 20 is mounted immediately behind objective lens 12 on the inner vacuum-exposed surface of the window portion of the tube and before microchannel plate 22. Typically, this photocathode 20 is a circular disk-like structure having a predetermined construction of semiconductor materials, and is mounted on a substrate in a well known manner. Suitable photocathode materials are generally semiconductors such as gallium arsenide; or alkali metals, such as compounds of sodium, potassium, cesium, and antimony (commercially available as S-20), carried on a readily available transparent substrate. A variety of glass and fiber optic substrate materials are commercially available.

Considering in somewhat greater detail the operation of the $I^2T$ 14, it is seen that in response to photons 36 entering the forward end of night vision device 10 and passing through objective lens 12, photocathode 20 has an active surface 38 from which are emitted photoelectrons in numbers proportionate to and at locations replicative of the received optical energy of the night-time scene being viewed. In general, the image received will be too dim to be viewed with human natural vision, and may be entirely or partially of infrared radiation which is invisible to the human eye. It is thus understood that the shower of photoelectrons emitted from the photocathode are representative of the image entering the forward end of $I^2T$ 14. The path of a typical photoelectron emitted from the photon input point on the photocathode 20 is represented in FIG. 1 by dashed line 40.

Photoelectrons 40 emitted from photocathode 20 gain energy through an electric field of predetermined intensity gradient established between photocathode 20 and electron-receiving face 28, which field gradient is provided by power source 42. Typically, power source 42 will apply an electrostatic field voltage on the order of 200 to 800 volts to create a field of the desired intensity. After accelerating over a distance between the photocathode 20 and the input surface 28 of the microchannel plate 22, these photoelectrons 40 enter microchannels 32 of microchannel plate 22. As will be discussed in greater detail below, the photoelectrons 40 are amplified by emission of secondary electrons to produce a proportionately larger number of electrons upon passage through microchannel plate 22. This amplified shower of secondary-emission electrons 44, also accelerated by a respective electrostatic field generated by power source 46, then exits microchannels 32 of microchannel plate 22 at electron-discharge face 30.

Once in free space again, the amplified shower of photoelectrons and secondary emission electrons is again accelerated in an established electrostatic field provided by power source 48. This field is established between the electron-discharge face 30 and display electrode assembly 24. Typically, the power source 48 produces a field on the order of 3,000 to 7,000 volts, and more preferably on the order of 6,000 volts in order to impart the desired energy to the multiplied electrons 44.

The shower of photoelectrons and secondary-emission electrons 44 (those ordinarily skilled in the art will know that considered statistically, the shower 44 is almost or entirely devoid of photoelectrons and is made up entirely or almost entirely of secondary emission electrons. Statistically, the probability of a photoelectron avoiding absorption in the microchannels 32 is low). However, the shower 44 is several orders of magnitude more intense than the initial shower of photoelectrons 40, but is still in a pattern replicating the image focused on photocathode 20. This amplified shower of electrons falls on the phosphor screen 26 of display electrode assembly 24 to produce an image in visible light.

Viewing FIG. 2 in greater detail, the $I^2T$ 14 is seen to include a tubular body 50, which is closed at opposite ends by a front light-receiving window 52, and by a rear fiber-optic image output window 54. The window 54 defines the light output surface 14*b* for the tube 14, and carries the coating 26, as will be further described. As is illustrated in FIG. 2, the rear window 54 may be an image-inverting type (i.e., with optical fibers bonded together and rotated 180° between the opposite faces of this window 54 in order to provide an erect image to the user 18. The window member 54 is not necessarily of such inverting type. Both of the windows 52 and 54 are sealingly engaged with the body 50, so that an interior chamber 56 of the body 50 can be maintained at a vacuum relative to ambient. The tubular body 50 is made up of plural metal rings, each indicated with the general numeral 58 with an alphabetical suffix added thereto (i.e., 58*a*, 58*b*, 58*c*, and 58*d*) as is necessary to distinguish the individual rings from one another.

The tubular body sections 58 are spaced apart and are electrically insulated from one another by interposed insulator rings, each of which is indicated with the general numeral 60, again with an alphabetical suffix added thereto (i.e., 60*a*, 60*b*, and 60*c*). The sections 58 and insulators 60 are sealingly attached to one another. End sections 58*a* and 58*d* are likewise sealingly attached to the respective windows 52 and 54. Those ordinarily skilled in the pertinent arts will know that the body sections 58 are individually connected electrically to a power supply 62 (which provides sources 42, 46, and 48, as described above), and which is effective during operation of the $I^2T$ 14 to maintain an electrostatic field most negative at the section 58*a* and most positive at the section 58*d*.

Further viewing FIG. 2, it is seen that the front window 52 carries on its rear surface within the chamber 56 the photocathode 20. The section 58*a* is electrically continuous with the photocathode by use of a thin metallization (indicated with reference numeral 58*a*') extending between the section 58*a* and the photocathode 20. Thus, the photocathode by this electrical connection and because of its semi-conductive nature, has an electrostatic charge distributed across the areas of this disk-like photocathode structure. Also, a conductive coating or layer is provided at each of the opposite faces 28 and 30 of the microchannel plate 22 (as is indicated by arrowed numerals 28*a* and 30*a*). Power supply 46 is conductive with these coatings by connection to housing sections 58*b* and 58*c*. Finally, the power supply 48 is conductive with a conductive layer or coating (possibly an aluminum metallization, as mentioned above) at the display electrode assembly 24 by use of a metallization also extending across the vacuum-exposed surfaces of the window member 54, as is indicated by arrowed numeral 54*a*.

It should be noted in considering the description below of the structure and operation of the power supply 62, that the term "image intensifier tube" is used in a generic sense. Those ordinarily skilled in the pertinent arts will appreciate that the tube being powered may be configured as an electron multiplier tube in which the output is an electrical signal rather than a visible image. Also, the tube being powered may be of the photodetector, phosphorescence detector, or scintillation detector type, in which the output is also an electrical signal rather than a visible image. Such tubes are generally used, for example, to detect a phosphorescent response in a chemical reagent exposed to exciting light of another color or wavelength, or in a detector for high-energy events having as a result of their occurrence the production of a small number of photons (i.e., as few as one photon per event).

Such application of tubes having a photocathode and a dynode (either of microchannel plate configuration with many dynodes, or of another configuration with one or more dynodes) may experience some or all of the difficulties in operation which are described above in the context of night vision devices. Accordingly, it will be appreciated that a power supply embodying principles of this invention may be used in such applications.

FIG. 3 is a section of a prior art power supply used to deliver high voltage to the photocathode of a prior art night vision device.

As shown in FIG. 3, the power supply section includes secondary windings 101 and 103 of a power supply's transformer (the primary winding of which is not shown). Winding 103 is a low voltage winding, while winding 101 is high voltage winding, and these are connected in series as seen in FIG. 3.

The output from the high voltage winding 101 is delivered to a cathode multiplier circuit 105. As is well known in the art, this circuit multiplies and rectifies the series combination voltage received from the windings 101 and 103. The output of the cathode multiplier 105 is delivered through a resistor 107 to the photocathode 109.

The prior art power supply section shown in FIG. 3 also includes a clamping circuit. This circuit consists of the low voltage winding 103 being rectified by a diode 111 and filtered by a capacitor 113. The DC voltage developed across the capacitor 113 is then used to clamp the voltage on the photocathode 109 through the use of a clamping diode 115. The common connection 106 to the cathode multiplier 105 is also connected to this DC voltage. The circuit shown in FIG. 3 also shows an MCP 117. The intrinsic capacitance between the photocathode 109 and the MCP 117 is shown as a dotted-line capacitor 119.

As is well known in the art, the cathode multiplier 105 in FIG. 3 operates to multiple and rectify the high voltage coming from the winding 101. The output of the cathode multiplier 105 is delivered to the photocathode 109 through the voltage-dropping resistor 107. As the average intensity of the scene delivered to the photocathode 109 increases, the current through the photocathode 109 also increases.

During lower-intensity scenes, all of this current goes through the dropping resistor 107. The net result is that the voltage delivered to the photocathode varies inversely with scene intensity during low-to-mild scene intensities.

Figure 5:
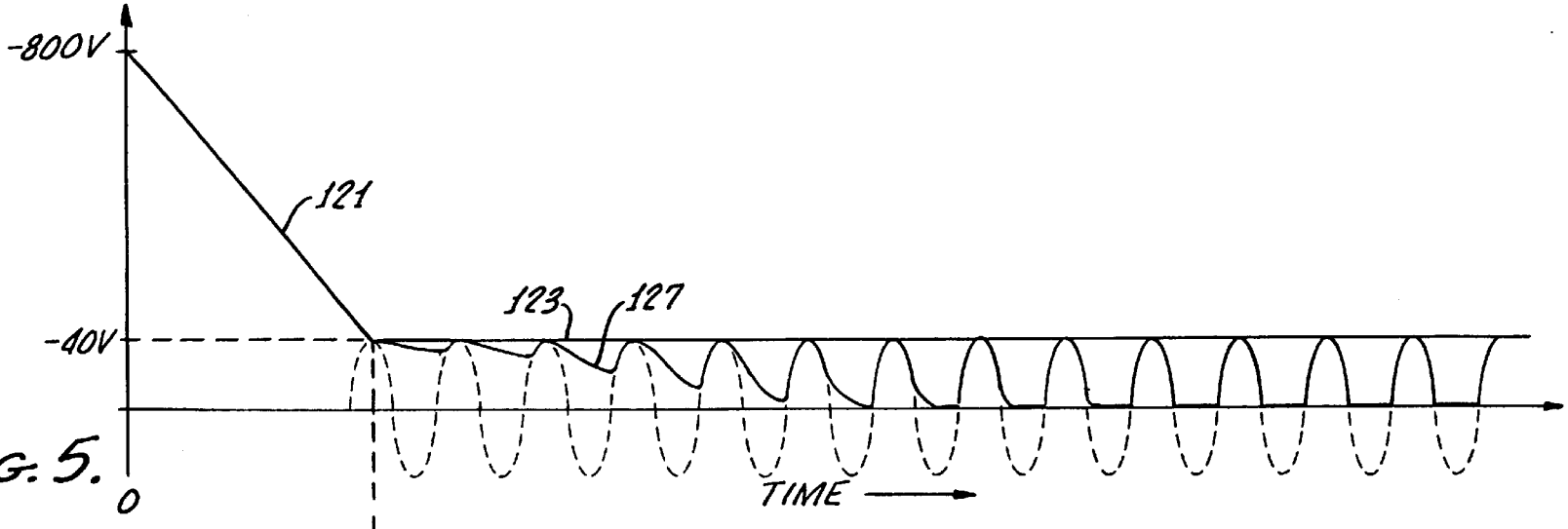
FIG. 5 is a graph showing the voltage delivered to the photocathode using the prior art power supply section illustrated in FIG. 3 and the section made in accordance with one embodiment of the present invention shown in FIG. 4.

This relationship between the current which is traveling through the photocathode 109 and the voltage which is delivered to it during low-to-modest scene intensities is illustrated by line segment 121 in FIG. 5. The X axis of FIG. 5 represents time. The Y axis of FIG. 5 represents the voltage being delivered to the photocathode. Although not explicitly shown in FIG. 5, it is to be understood that the average scene intensity is steadily increasing as a function of time.

As explained above, however, the photocathode 109 will effectively stop functioning if the voltage applied to it is less than its charge voltage. In order to insure against this condition, the clamping diode 105 turns on when the voltage to the photocathode 109 goes below a pre-determined threshold (e.g., 40 volts).

The pre-determined threshold is designed to be higher than the charge voltage of the photocathode. Once the clamping diode 115 turns on, it effectively clamps the voltage delivered to the photocathode 109 to the clamping voltage developed across the capacitor 113, less the voltage drop of the clamping diode 115.

As also shown in FIG. 5, the voltage which is delivered to the photocathode 109 after the clamping diode 115 turns on remains constant, notwithstanding continued increases in the intensity of the scene. This constant clamped level is illustrated by horizontal line segment 123 in FIG. 5.

Figure 6:
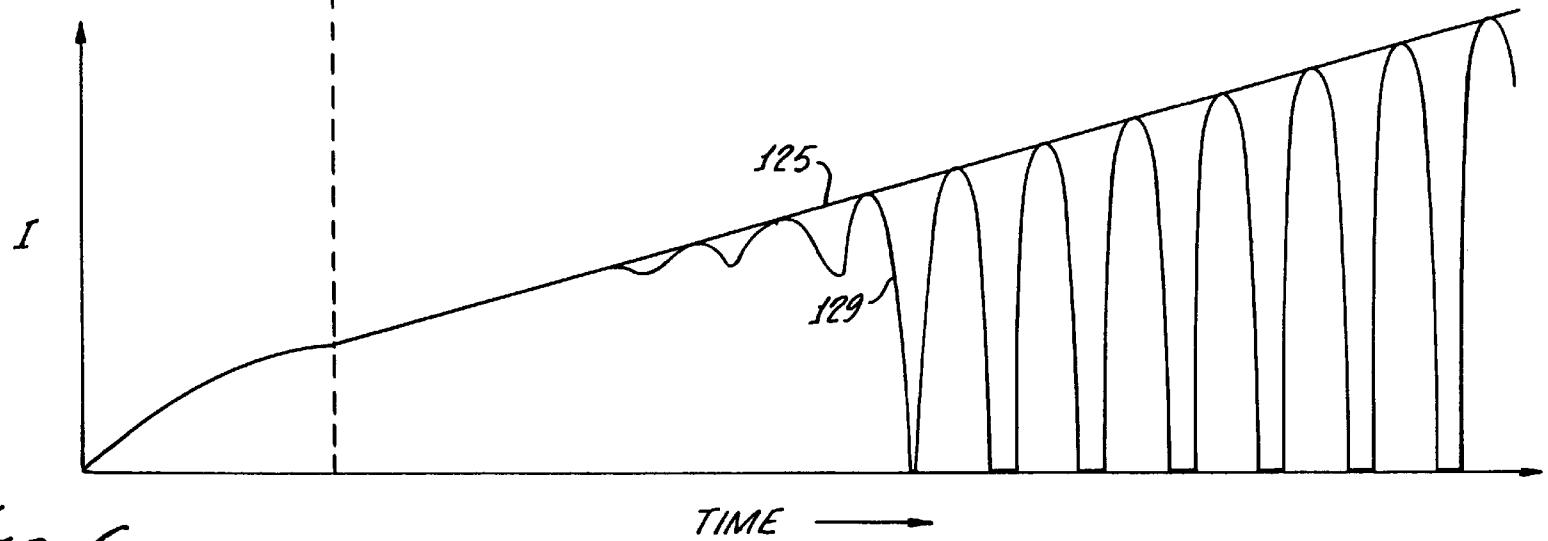
FIG. 6 is a graph showing the current traveling through the photocathode using the prior art power supply section illustrated in FIG. 3 and the section made in accordance with one embodiment of the present invention shown in FIG. 4.

Line 125 in FIG. 6 illustrates the current which is traveling through the photocathode 109 while the voltage to the photocathode 109 is varying as shown in lines 121 and 123 in FIG. 5. As can be seen in FIG. 6, the current to the photocathode 109 continues to climb after the voltage is clamped. Because the level of the clamping voltage must be set to insure continued operation of all photocathodes to which the circuitry in FIG. 3 is connected, and because of substantial variations in the charge voltage of these photocathodes, the clamping level must by necessity be substantially higher than the charge voltages for most of the photocathodes. As shown in FIG. 6, this causes the current through the photocathode 109 to increase substantially with increasing scene intensities, even after the clamping level is reached. In turn, this causes undesirable degradation in the resolution and reliability of the photocathode 109.

Figure 4:
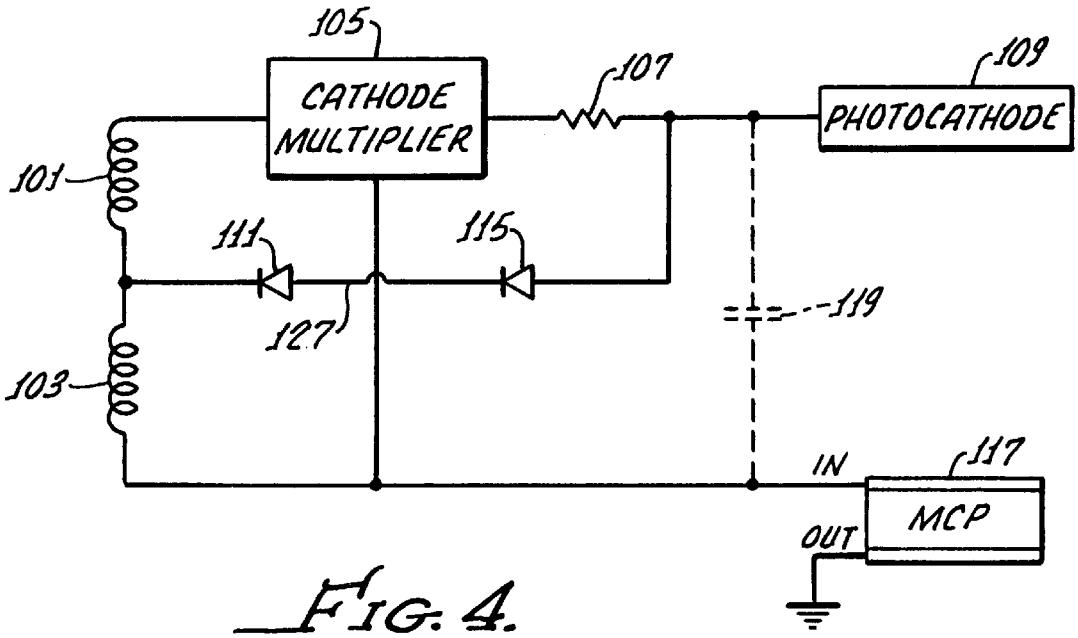
FIG. 4 is a schematic illustration of a section of a power supply used to deliver high voltage to the photocathode of a night vision device made in accordance with one embodiment of the present invention.

FIG. 4 is a schematic illustration of a section of a power supply used to deliver high voltage to the photocathode of a night vision device made in accordance with one embodiment of the present invention. As should be apparent, it is the exact same circuit shown in FIG. 3, with two modifications. The common connection 106 from the cathode multiplier 105 is connected directly to the input to the MCP 117; and the filtering capacitor 113 has been removed.

This seemingly simple modification to the prior art circuit achieves a profound enhancement in performance.

Like the prior art system in FIG. 3, a clamping voltage is also developed at point 123 in FIG. 4. Unlike the DC clamping voltage which is developed at point 123 in FIG. 3, however, it is a time-varying AC voltage at point 123 in FIG. 4. The reason for this difference, of course, is the removal of the filtering capacitor 113 from the circuit shown in FIG. 3.

Prior to the current being conducted through the clamping diode 115, the operation of the circuit in FIG. 4 is the same as the operation of the circuit in FIG. 3. The voltage to the photocathode 109 continues to decrease as a function of the current traveling through the photocathode 109, as shown by the line segment 121 in FIG. 5. Once the voltage applied to the photocathode 109 decreases to the clamping level, however, a significant difference materializes. Instead of the steady-state DC clamping voltage 123 being applied, a time varying clamping voltage 127 is instead applied, all as shown in FIG. 5. Also as shown in FIG. 5, the magnitude of the variations in the time-varying clamping voltage 127, continue to increase as the intensity of the scene continues to increase until the variations approximate the appearance of a half-wave rectified sine wave, as also shown in FIG. 5. (It is noted that the falling edges of the time-varying waveform are softened by the residual current contained in the effective capacitance 119 between the photocathode 109 and the MCP 117.) This time-varying voltage is delivered to the photocathode 109 even during periods when the scene intensity and thus average current through the photocathode 109 is not changing.

The presence of this time-varying voltage on the photocathode 109 has a marked effect upon the average current delivered to the photocathode 109, as shown by graph segment 129 in FIG. 6.

The combined effect of the time-varying voltages and currents shown in line segments 127 and 129, respectively, result in a marked improvement in the resolution and reliability of the photocathode 109. Because the peaks of the time-varying voltage 127 continued to be above the charge voltage of the photocathode 109, the photocathode 109 continues to faithfully operate during periods of high scene intensity. At the same time, however, the average current which is flowing through the photocathode 109 during high scene intensities is substantially less than the current which would have been delivered by the prior art system shown in FIG. 3.

Those skilled in the art will appreciate that the embodiment of the present invention depicted and described herein is not exhaustive of the invention. For example, other forms of time-varying waveforms could also be applied to the photocathode, such as a square wave or saw-tooth wave. Although shown only to operate in the time-varying mode after reaching the clamped voltage, it is to be understood that the voltage applied to the photocathode could include a substantial time-varying component throughout the entire range of scene intensities delivered to the photocathode, or throughout ranges of this intensity other than the ones thus-far discussed. Although a particular circuit has thus-far disclosed for generating this time-varying voltage, of course, it is to be understood that a broad variety of different types of circuits could also advantageously be used. The circuit which has been selected is merely one that can be implemented by making a seemingly minor change to a popular existing conventional circuit, that is the circuit shown in FIG. 3.

Those skilled in the art will further appreciate that the present invention may be embodied in other specific forms without departing from the spirit or attributes of the invention. The foregoing descriptions of the present invention disclose only exemplary embodiments. It is to be understood that other variations are recognized as being within the scope of the present invention. The present invention is not limited to particular embodiments which have been described. Rather, reference should be made to the appended claims which are intended to define the scope and content of the present invention.

I claim:

1. A night vision device having an objective lens receiving light from a scene being viewed and directing this light to an image intensifier tube, said image intensifier tube providing a visible image of the scene being viewed, and an eyepiece lens providing this visible image to a user of the night vision device; said image intensifier tube including a photocathode receiving photons from the scene and releasing photoelectrons in a pattern replicating the scene, a microchannel plate receiving the photoelectrons and providing a shower of secondary emission electrons in a pattern replicating the scene, and a screen receiving the shower of secondary emission electrons and producing a visible image replicating the scene; said night vision device including a source of electrical power at a selected voltage level, and a power supply circuit receiving said electrical power at said selected voltage level to responsively provide electrical power at higher voltage levels to said photocathode, to opposite faces of said microchannel plate, and to said screen, wherein said power supply circuit Her includes means for supplying said higher voltage level to said photocathode substantially as a half-wave rectified sine wave.

2. The device of claim 1 wherein said power supply circuit includes means for supplying said half-wave rectified sine wave voltage level to said photocathode during periods when scene light is above a selected level in average intensity and a reduction in the current to the photocathode is needed to compensate.

3. The device of claim 2 wherein said power supply circuit includes a clamping circuit having an alternating current source.

4. The device of claim 3 wherein said clamping circuit includes a low-voltage source and a high-voltage source, and a diode connected to a connection intermediate of said low-voltage source and said high-voltage source and to said photocathode.

5. The device of claim 4 wherein said clamping circuit includes two diodes connected in series to said photocathode and to a connection intermediate of said low-voltage source and said high-voltage source.

6. A power supply for delivering a high voltage to the photocathode of a night vision device; said power supply circuit including means for supplying said high voltage to said photocathode substantially as a half-wave rectified sine wave.

7. The power supply of claim 6 wherein said power supply circuit includes means for supplying said high voltage to said photocathode substantially as a half-wave rectified sine wave during periods when scene brightness is above a determined level on average and a reduction in the current to the photocathode is needed to compensate.

8. The power supply of claim 7 wherein said power supply circuit includes a clamping circuit having an alternating current source.

9. The power supply of claim 8 wherein said clamping circuit includes a low-voltage source and a high-voltage source, and a diode connected to a connection intermediate of said low-voltage source and said high voltage source and to said photocathode.

10. The power supply of claim 9 wherein said clamping circuit includes two diodes connected in series to said photocathode and to a connection intermediate of said low-voltage source arid said high-voltage source.

11. In a night vision device having a photocathode on which light from a scene is directed and a power supply circuit providing voltage and current flow to the photocathode, said photocatwode responsively liberating photoelectron as a function of both light intensity incident upon the photocathode from said scene and voltage level effective upon said photocathode from said power supply circuit, a method of reducing the current delivered to the photocathode when the photocathode is receiving light from the scene which in average intensity is at or above a certain value, said method including the step of applying a time-varying voltage having a voltage wave form which is substantially a rectified half-wave sine wave to the photocathode.

12. The method of claim 11 wherein said step of applying a time-varying voltage having a voltage wave form which is substantially a rectified half-wave sine wave to the photocathode is conducted by including in said power supply circuit a pair of voltage sources, of which one of said pair of voltage sources is a low-voltage source and the other of said pair of voltage sources is a high-voltage source.

13. The method of claim 12 wherein said step of applying a time-varying voltage having a voltage wave form which is substantially a rectified half-wave sine wave to the photocathode is conducted by connecting said one of said pair of voltage sources and said another of said pair of voltage sources in series, and connecting a diode between a connection intermediate of said pair of series connected voltage sources and said photocathode.

14. The method of claim 11 wherein said step of applying a time-varying voltage having a voltage wave form which is substantially a rectified half-wave sine wave to the photocathode is conducted by limiting filtering capacitance effective between said photocathode and a microchannel plate of said night vision device to substantially only that inherent capacitance presented by the juxtaposed photocathode and microchannel plate themselves, and substantially without any added separate filter capacitor.

* * * * *